United States Patent [19]

Vinnemann

[11] 3,995,451

[45] Dec. 7, 1976

[54] PATTERNING MECHANISM

[75] Inventor: Antonius Vinnemann, Stuttgart, Germany

[73] Assignee: Firma Franz Morat GmbH, Stuttgart-Vaihingen, Germany

[22] Filed: Apr. 17, 1974

[21] Appl. No.: 461,803

Related U.S. Application Data

[63] Continuation of Ser. No. 239,162, March 29, 1972, abandoned.

[30] Foreign Application Priority Data

Mar. 30, 1971 Germany ..... 2115332

[52] U.S. Cl. ..... 66/50 R; 310/8.6

[51] Int. Cl.[2] ..... D04B 15/78

[58] Field of Search ..... 66/25, 50 R, 50 A, 50 B, 66/75, 154 A; 310/8.5, 8.6, 26

[56] References Cited

UNITED STATES PATENTS

| | | | |
|---|---|---|---|
| 2,348,932 | 5/1944 | Scrantom | 66/50 R |
| 2,542,075 | 2/1951 | Firth | 310/26 |
| 3,110,824 | 11/1963 | Flanagan | 310/8.5 |
| 3,365,915 | 1/1968 | Schmidt | 66/25 |
| 3,449,928 | 6/1969 | Schmidt et al. | 66/50 R |
| 3,622,815 | 11/1971 | Schafft | 310/8.6 |
| 3,733,855 | 5/1973 | Bliss-Hill et al. | 66/50 R |
| 3,807,197 | 4/1974 | Plath | 66/50 R |
| 3,812,691 | 5/1974 | Engelfried | 66/50 R |

FOREIGN PATENTS OR APPLICATIONS

| | | | |
|---|---|---|---|
| 1,543,601 | 10/1967 | France | 66/50 R |
| 1,920,531 | 11/1969 | Germany | 66/50 R |
| 1,964,337 | 7/1970 | Germany | 66/75 |
| 1,163,052 | 9/1969 | United Kingdom | 66/75 |

*Primary Examiner*—Mervin Stein
*Assistant Examiner*—A. M. Falik

[57] ABSTRACT

Patterning mechanism for electrically controllable knitting machines for selecting the knitting needles or their control elements, with which are associated bendable control springs having at least two positions for initiating selection operations according to pattern, for the completion of which at least a further auxiliary means is provided, the control springs being freely-oscillating active bending vibrators, as herein defined. The control springs may consist of piezo-electric elements controllable by an electric field or may consist of multilayer, bimetallic elements controllable by a magnetic field.

14 Claims, 14 Drawing Figures

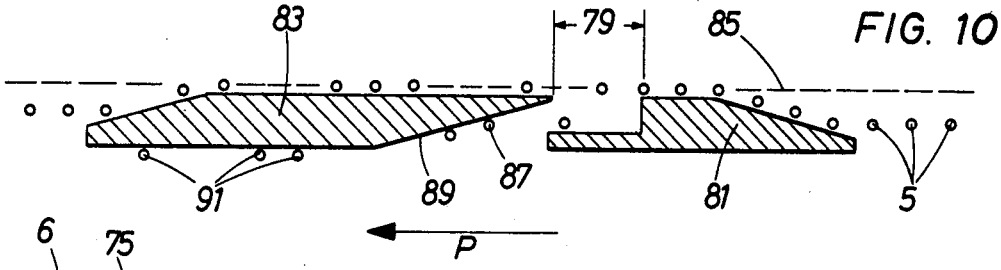
FIG. 10
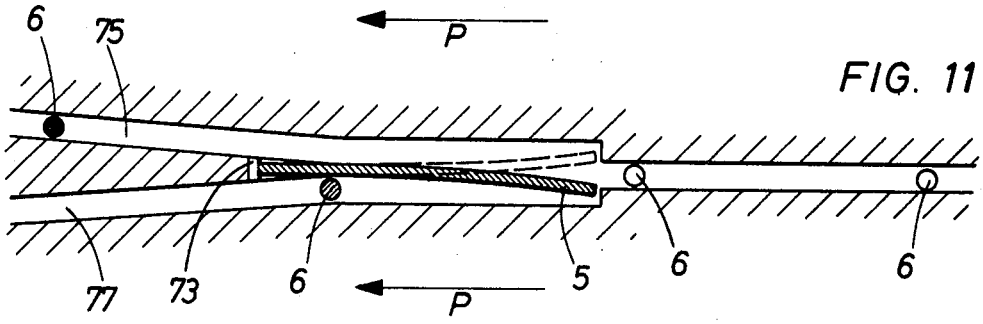
FIG. 11
FIG. 12
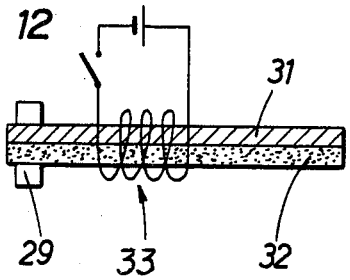
FIG. 13
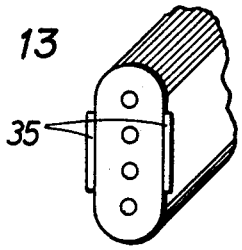
FIG. 14
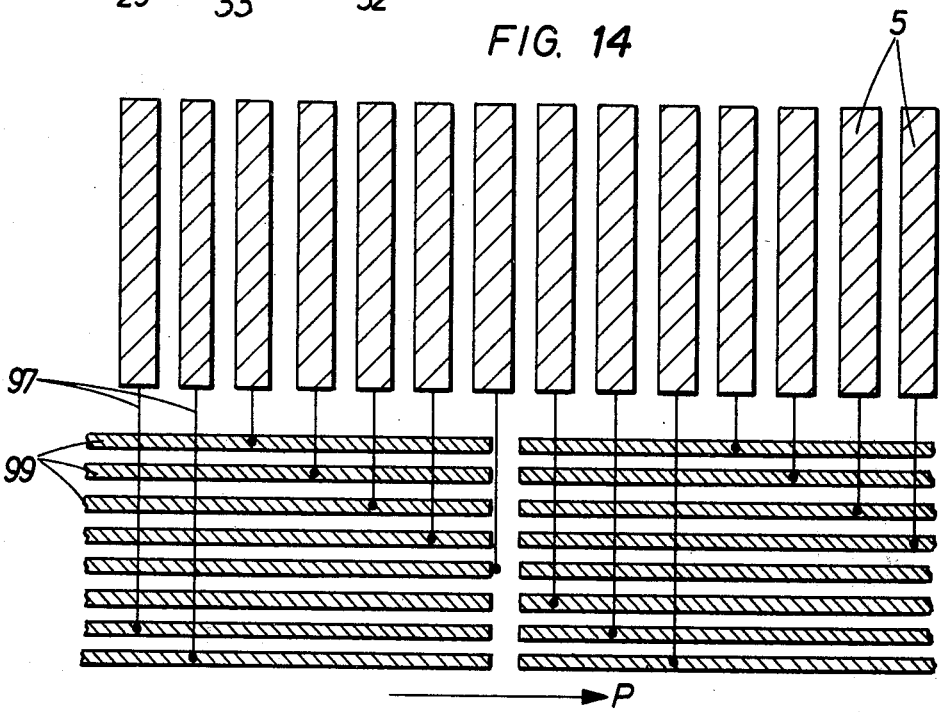

PATTERNING MECHANISM

This is a continuation of application Ser. No. 239,162, filed Mar. 29, 1972, now abandoned.

Three essential possibilities of electrical or electronic control of knitting machines have been known heretofore. Whereas the major proportion of electrically controllable knitting machines needs control magnet systems for needle selection (German Laid-open patent specification No. 1 585 211 and its corresponding U.S. Pat. No. 3,449,928 ), it is also already known either to employ stepping motors for needle selection (Swiss patent specification No. 465 119 ) or to provide elements (German Laid-open Pending patent application Ser. No. 1 804 350 and corresponding British Pat. No. 1,227,169effect of an electric current and possess piezoelectric or electro- or magnetostrictive properties.

In the control of knitting machines by means of stepping motors there is the drawback that the toothed wheels coupled to the stepping motors act directly on the knitting needles or their control elements and must overcome high frictional forces in the process, so that needle selection in the millisecond range is not possible or is extremely costly. Needle selection by means of piezoelectric or electro- or magnetostrictive elements also cannot be achieved in the manner already known with the materials available today, because with such elements only forces of the order of magnitude of a few grams can be applied. Even with the interposition of force intensifiers, these forces are not sufficient for shifting needles or their control elements against frictional forces of at least 50 grams over distances of at least one millimeter with frequencies between 50 and 1000 c/s. Finally, it is true that control equipment for knitting machines operating with control magnet systems has the advantage that when a passive control spring is used per needle a control operation can be initiated within about 1 millisecond, namely if the needles or their control elements are lifted by resilient bending of the control spring on to a cam curve completing the control operation. A fundamental disadvantage of this and all other electromagnetic control arrangements, however, consists in that the control magnet systems require a high degree of precision and consequently a high expenditure for electronics.

The problem underlying the invention, therefore, is to propose an electric control system for knitting machines which requires a relatively small degree of precision and nevertheless has the advantage of a high working frequency, even if the needle selection takes place in only one plane instead of a plurality of planes (Swiss patent specification No. 362 787 ).

To this end, the invention starts from a patterning mechanism for electrically controllable knitting machines for selecting the knitting needles or their control elements with which are associated bendable control springs having at least two positions for initiating selection opertions according to pattern, for the completion of which at least a further auxiliary means is provided.

The invention is characterised in that the control springs are freely-oscillating active bending vibrators.

By the term "active bending vibrators" there is understood bending vibrators of the kind which can be bent or activated by impressing electric or magnetic fields, without supplementary mechanical or electromagnetic devices being required for the purpose, as is the case with the known passive control springs (German Laid-open patent specification No. 1 585 211 and corresponding U.S. Pat No. 3,449,928 ). The descriptive term "freely-oscillating" signifies that the bending of the bending vibrators takes place without any work, i.e. the bending vibrators do not need to perform any work on the bending thereof.

The invention brings considerable advantages with it. As control magnet systems are no longer required and each bending vibrator can be actuated separately, considerably larger periods of time than one millisecond are available for the control operations or for producing a certain bending state of the bending vibrators, so that the selection can take place in relatively broad selection zones and a low degree of precision is sufficient. The deflection of the bending vibrators without any work being done prevents them being stressed mechanically or destroyed by abrasion. Even bending vibrators which are able to achieve only forces of 1 or 2 grams on the bending thereof are therefore suitable for the purposes of the invention.

Bending vibrators within the meaning of the invention are, for example, bimetallic strips, multi-layer electro- or magnetostrictive materials and in particular the various natural or artificial piezoelectric crystals, of which the piezoelectric ceramic materials are particularly suitable. In endurance tests, multi-layer piezoelectric bending vibrators consisting of certain alkaline-earth titanates have proved themselves, deflection of some millimeters being obtainable with them when they are clamped at one end. There are known, for example, bending vibrators of barium titanate, lead-barium titanate and lead zirconate-titanate, that is compounds which are generally designated as oxide ceramics. Also known are so-called trilaminar piezoxides, which have two ceramic layers and an intermediate layer of metal for the purpose of increasing the mechanical strength, or the so-called multimorph elements, which are produced in one piece by the extrusion method.

The invention is described hereinafter in conjunction with the accompanying drawing with the aid of a number of embodiments.

Figure 9:
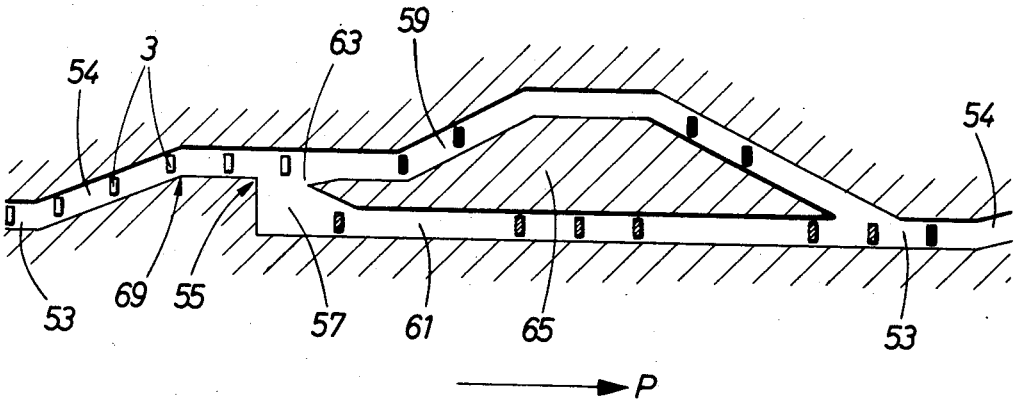

FIG. 9 is a diagramatic representation of the development of a segment of the cam box. FIG. 10 shows another constructional form of the cam box with control springs which are known per se from the prior art. FIG. 11 shows still another embodiment.

FIG. 10 shows another constructional form of the control springs known from the prior art.

FIG. 11 shows another embodiment of the invention.

FIGS. 12 and 13 show two constructional forms of the bending vibrators which can be employed according to the invention;

FIG. 14 shows an arrangement of contact paths for acting on the bending vibrators according to FIG. 12.

According to FIGS. 1 to 8, all the sliders 1 with butts 3 each have at least one control spring 5 associated with them. The sliders 1 move up and down in grooves 7 of the needle cylinder 9 of a circular knitting machine or of the needle bed of a flat knitting machine and can act in known manner on knitting needles 2 during their upward and downward movement. When the sliders 1 are in their working position according to FIG. 2, the butts 3 project into a guide track 11 of a cambox 13 surrounding the needle cylinder 9, if the machine is a circular knitting machine. On the other hand, if the machine is a flat knitting machine, then the butts 3 project from the grooves 7 in such manner in the working position that they are able to come into the range of the cam which can be reciprocated over the length of the machine. In the region of each feed, the guide track 11 has a section 15 extending in roughly triangular form in the vertical direction, so that all the sliders 1 which are in the working position are raised at the feeds in order to bring the needles 2 located above them into the intercepting or knitting position.

Figure 2:
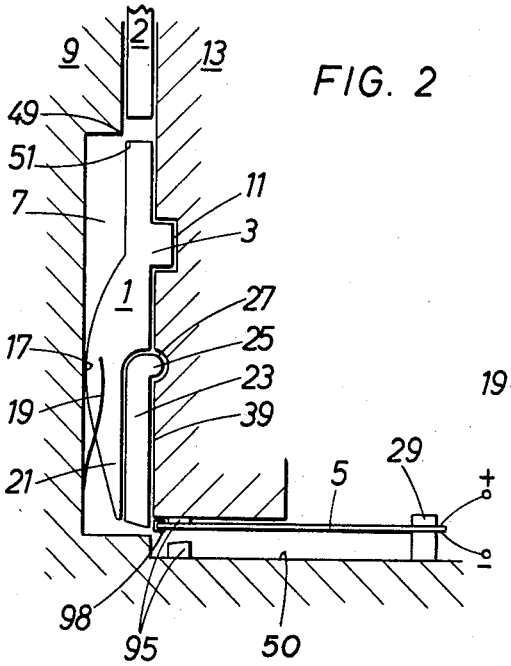
FIGS. 2 to 8 show the positions taken by the sliders, the auxiliary sliders, and the control springs with respect to section lines 2—2, 3—3, 4—4, 5—5, 6—6, 7—7, and 8—8, as the needle cylinder rotates in the direction of arrow P.
Figure 4:
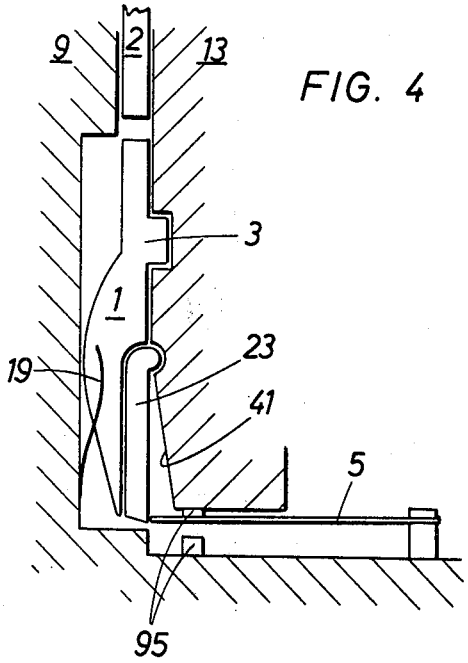
Figure 5:
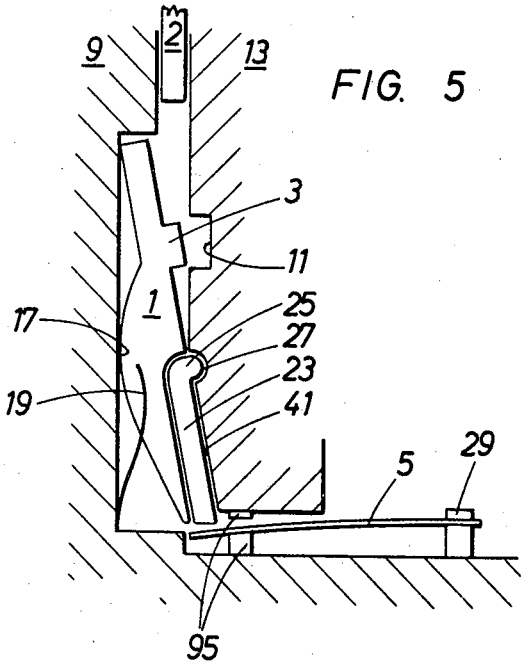
Figure 6:
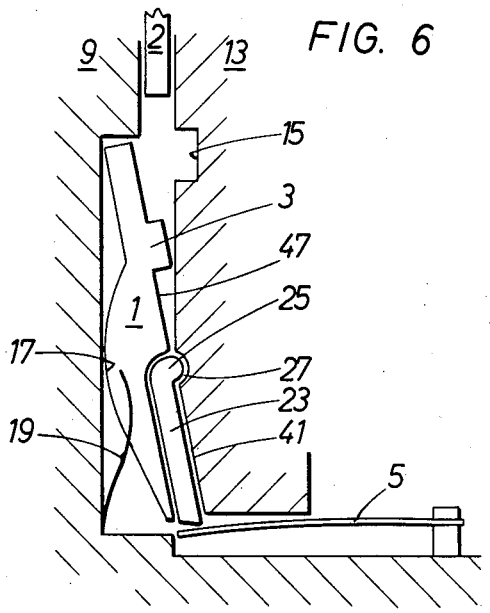

The rear portion of the sliders 1, which is located in a groove 7, is rounded so that the sliders can be rocked in the radial direction about that point 17 at which they bear against the bases of the grooves (FIGS. 2, 5, 6). According to FIGS. 2 to 8, there is connected with each slider 1 a pressure spring 19, one end of which acts on the lower portion 21 of the slider 1 and the other end of which is supported at the base of the groove. The pressure spring 19 tends to rock the slider 1 in the radial direction about the point 17 in such manner that its butt 3 is forced out of the guide track 11 (FIGS. 5, 6).

In the grooves 7, moreover, an auxiliary sinker 23 with a butt 25 is arranged in each case between the lower recessed portions 21 of the sliders and the cambox 13, the auxiliary sinker sliding in a guide track 27 of the cambox 13. The butt 25 and the guide track 27 are so rounded that the auxiliary elements or sinkers 23 are pivotable in the radial direction about the butts 25.

Figure 3:
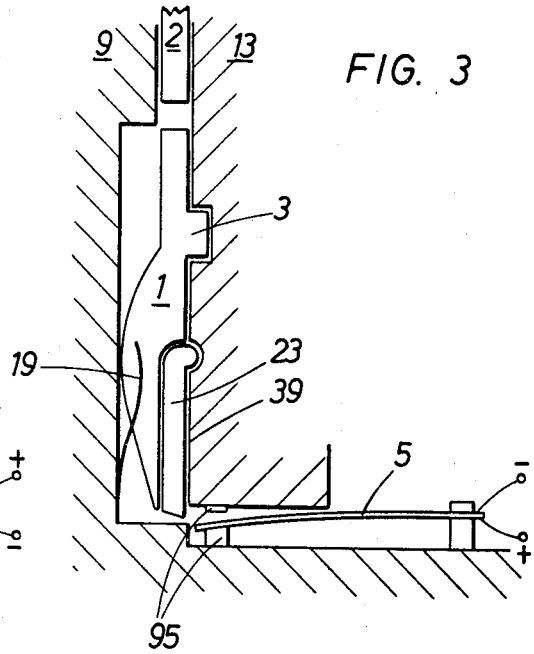
Figure 7:
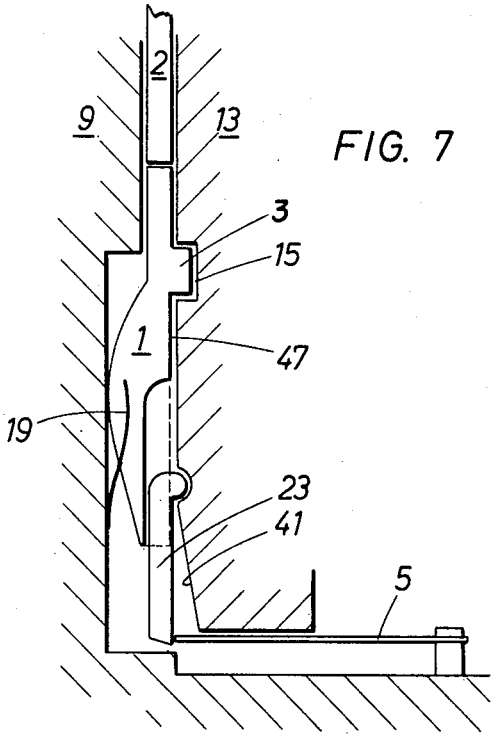

The control springs 5 associated with the sliders 1 and their pivotable auxiliary sinkers 23 are clamped at one end in a block 29 fixed to the needle cylinder 9 and are normally in a nondeflected state, which is shown in FIGS. 2, 4 and 7 and from which they can be brought into a fully deflected state as shown in FIGS. 3 and 5.

According to the invention, each control spring 5 is in the form of a bending vibrator. If this is a magnetostrictive bending vibrator according to FIG. 12, then this consists, for example, of two strips 31, 32 which expand in different degrees when a magnetic field is impressed thereon and produce a bending of the bending vibrator. The magnetic field may be produced in each case by means of a coil 33 which is connected to a battery via a control switch. If the control spring is a bimetallic strip or an electrostrictive bending vibrator, then the strips 31, 32 likewise consist of different materials which are connected directly in known manner to a battery by way of a control switch and likewise produce a bending of the bending vibrator by reason of their different degrees of thermal expansion of their different electrostrictive properties. Finally, according to FIG. 13, it is also possible to employ piezoelectric bending vibrators which have been made either in multi-layer form or in one piece by the extrusion process. The last-mentioned bending vibrators generally have outer electrodes 35 which are connected to a battery via a suitable control switch when a bending of the bending vibrator is effected by the resultant electric field.

Figure 1:
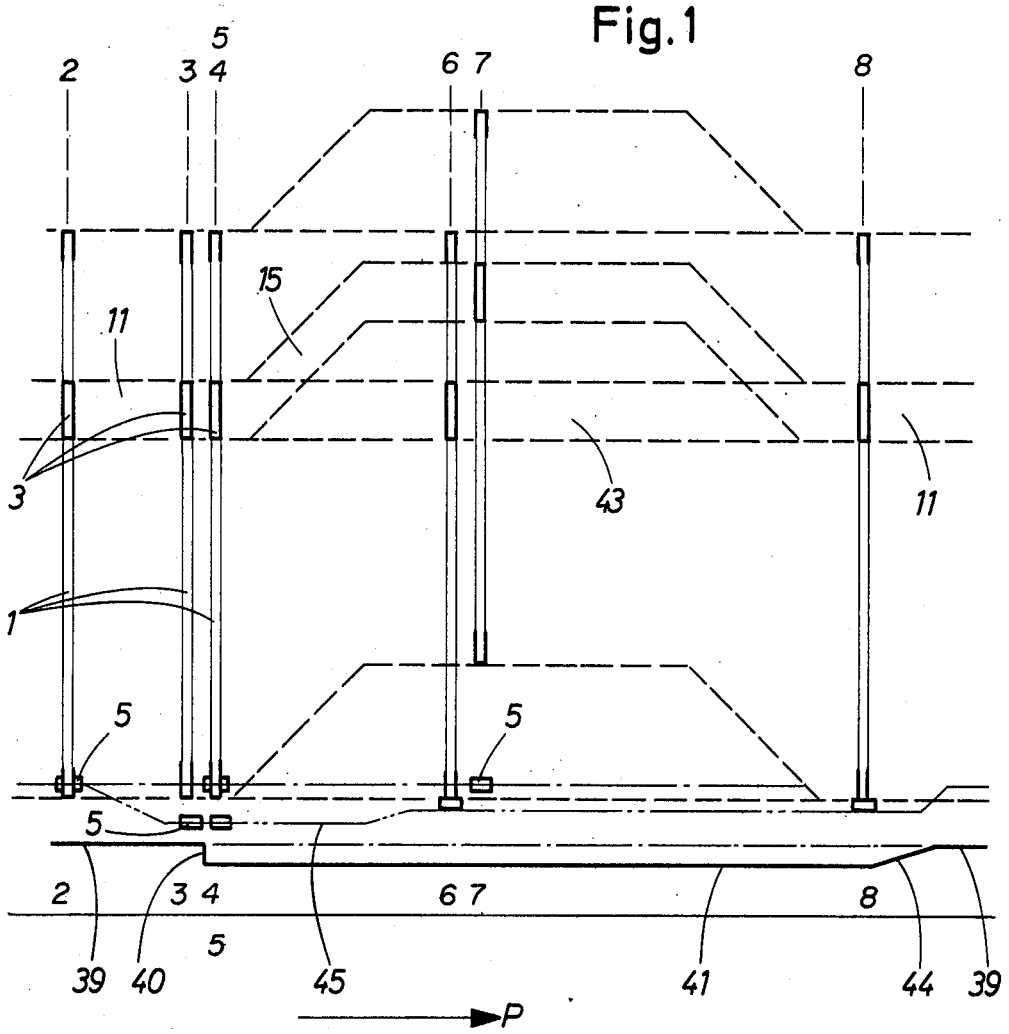
FIG. 1 shows diagrammatically the development of a segment of the cambox with the control elements required for needle selection in accordance with the invention in various positions.

The operation of a knitting machine with control springs 5 of this kind in the form of bending vibrators will be apparent by reference to FIGS. 2 to 8, it being assumed that the needle cylinder 9 rotates in the direction of the arrow P (FIG. 1). In front of each feed, which according to FIG. 1 is located approximately between the section lines 4—4 and 8—8, all the sliders adopt the position shown in FIG. 2, in which their auxiliary sinkers bear against a part 39 of the cambox 13 in such manner that they do not touch the front ends of the control springs 5 opposite them. Within a selection zone which in FIG. 1 may already begin to the left of the section line 2—2 and terminates approximately between the section lines 3—3 and 4—4 control springs 5 are actuated in accordance with the pattern. The actuation of the control springs 5 is effected so early in time that, if they are to bend, they are deflected with certainty in the region of the section line 3—3 in such manner that their front ends can no longer be applied against the auxiliary sinkers 23 when these are rocked. The position of the control springs 5 corresponding to the deflected state can be seen in FIG. 3, from which it is also apparent that in the needle cylinder 9 there is provided a recess 50 which makes the deflection of the control springs 5 possible. If the needle cylinder 9 is rotated further in the direction of the arrow P (FIG. 1), then the sliders 1 and their auxiliary sinkers 23 come into the region of the section line 4—4 or 5—5 at a point of the cambox 13 at which this has a recess the abrupt commencement of which is indicated in FIG. 1 by the reference number 40. The consequence of this is that, under the effect of the pressure springs 19, the sliders 1 are rocked about the points 17 and the auxiliary sinkers 23 about the butts 25 into a position according to FIG. 5 in which the auxiliary sinker 23 rests against a cam portion 41 if the associated control spring 5 has been deflected downwardly in the selection zone. If, on the other hand, the associated control spring 5 has not been deflected, then in accordance with FIG. 4, under the effect of the pressure spring 19, the auxiliary sinker is applied at its lower end against the underflected end of the control spring 5, so that the slider 1 and the auxiliary sinker 23 are rocked only through a very small angle.

On further rotation of the needle cylinder 9 in the direction of the arrow P, the butts 3 of all those sliders whose auxiliary sinkers 23 rest against a control spring 5 slide further in the guide track 11 and are consequently lifted by its triangular portion 15, so that they lift likewise the needles 2 associated with them. The highest position of the lifted sliders in the region of the section line 7—7 can be seen in section in FIG. 7. On the other hand, the butts 3 of all those sliders whose auxiliary sinkers are associated with a deflected control spring in accordance with FIG. 5 have already been forced out of the guide track 11 in the region of the section line 5—5 and consequently before the beginning of the triangular portion 15, so that the associated sliders are not lifted, but run through a miss track between the section lines 4—4 and 8—8, this miss track being designated by the reference 43 in FIG. 1. FIG. 6 shows this state for the region of the section line 6—6.

Figure 8:
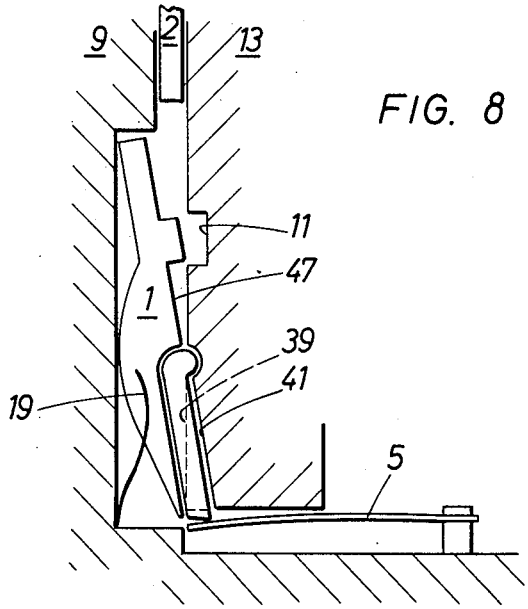

According to FIGS. 1 and 8, in the region of the section line 8—8, i.e. when all the lifted sliders 1 have been lowered again by the portion 15 of the guide track 11, there begins a gradually rising portion 44 of the cam portion 41 in the radial direction, as a result of which all the auxiliary sinkers 23 which have been rocked or swung and the associated sliders 1 are swung back again into the position shown in FIG. 2 in opposition to the force of the pressure spring 19.

It can be seen from FIGS. 1 to control spring that to the right of the section line 5—5 the deflected state of the control springs (FIG. 5) no longer needs to be maintained by application of an electrical or magnetic signal. If, in fact, by cutting off the magnetic or electric field, the control spring 5 is gradually transferred back to its original undeflected position, then, in accordance with FIGS. 1, 6 and 8, it is applied from below against the auxiliary sinker 23 until the latter has been swung back again by the rising portion 44 of the cam 41. The usual course for a deflected spring 5 is indicated in FIG. 1 by the broken line 45.

The function of the auxiliary sinkers 23 is apparent, for example, from FIG. 7. Were the auxiliary sinker 23 not present and were the front edge 47 of the sliders 1 to extend vertically as far as the lower end (shown in dashes), the lower end of the sliders would, it is true, be applied at first against the front end of the control spring 5 when it is not deflected. After the sliders have been lifted by the portion 15 of the guide track 11 by the height of a control spring 5, however, the lower end of the slider would be lifted away from the control spring, so that it will possibly still be swung under the effect of the pressure spring 19. According to another constructional form of the invention, in order to avoid this, the upper end 49 of the groove 7 may be arranged so closely above the upper end 51 of the slider 1 (FIG. 2) that when the slider is lifted away from the control spring 5 it is secured against any swinging effect. Since, however, very close tolerances must be preserved for this purpose, the described auxiliary sinkers 23 are preferably employed.

The bending vibrators 5 are preferably arranged horizontally, so that they are loaded in the axial direction by the auxiliary sinkers 23. In this way, it is also possible to use bending vibrators which consist of relatively brittle material and would break with too heavy loading in the direction of bending.

Another constructional form of the invention is shown in FIG. 9. This differs from the constructional form according to FIGS. 1 to 8 in that the control springs 5 are not arranged horizontally, but substantially vertically, and that for patterning purposes the sliders 1 are not rocked, but moved up and down.

The operation of this constructional form is apparent from FIG. 9. Before the selection point, all the slider butts 3 (shown white) are guided in a guide track 53 which ascends slightly in the zone 54 and has reached a midway height at a point 55 located just before the selection point. Beyond the point 55, the guide track 53, according to FIG. 9, has a transition point 57, in the region of which all the selected sliders 1 are either retained by the control springs 5 at the height reached at 55 and directed into a guide track 59 or else are released by the control springs 5 and consequently drop and enter a guide track 61.

As in the case of the embodiment first described, the actuation of the control springs 5 is preferably effected within a certain selection zone which may begin at the end of the ascending portion 54 of the guide track 53, i.e. approximately at the point 69, and extends approximately as far as the point 55. In this way, the possibility is provided also in this constructional form of actuating or triggering the control springs 5 not only in the relatively narrow zone of the transition point 57, but in a relatively broad zone. The mechanical loading of the bending vibrators 5 is again effected substantially in the axial direction.

In FIG. 9, the slider butts 3 selected in the region of the transition point 57 for initiating the knitting operation are shown in black, while the butts 3 of the sliders selected for not knitting or missing are shown shaded. That point at which the butts both of the selected and of the unselected sliders enter the guide track 53 again may be followed immediately by another ascending portion 54 and consequently by another feed.

In a third constructional form according to FIG. 10, the control springs 5 known from German Laid-open patent specification No. 1 585 211 (U.S. Pat. No. 3,449,928) are in the form of bending vibrators, so that the control magnet systems can be dispensed with. For the selection without work of certain control springs 5, they may be slightly biased in known manner in front of a gap 79 between two cam parts 81 and 83 and, in the region of the gap 79, either held in the position indicated by the dash line 85 or brought into their second bending position, which is indicated by the control springs 87. In this latter position, they then slide on to an incline 89 of the cam 83 when the needle cylinder is rotated further in the direction of the arrow P. The height of the incline is so chosen that the control springs 87 which are not yet in contact with the needles or sliders are urged against the needles or sliders by the incline 89 and thereby produce a swinging movement thereof.

In the constructional form according to FIG. 10, it is not necessary to bias the control springs 5 by means of the cam 81. It would also be possible to bring the control springs 5 up to the gap 79 along the dash line 85 in an undeflected state. Due to the bias, however, the advantage is obtained that the selection operation is assisted by the elastic spring force. The actuation or triggering of the control springs 5 in the form of bending vibrators can be effected in both cases within a longer selection zone extending, for example, from the beginning of the cam 81 as far as the gap 79 or fixed by the width of the gap 79.

The constructional form of the invention illustrated in FIG. 11 differs from the constructional forms described so far in that control springs 6, which are indicated only diagrammatically, are in the form of passive control springs within the meaning of German Laid-open patent specification No. 1 585 211 (U.S. Pat. No. 3,449,928). A routing element or deflector in the form of a bending vibrator 5 serves in this case as a selecting element, the routing element being clamped at 73 between two guide tracks 75 and 77 formed in the cam-box. The control springs 6 fixed in known manner, for example to the needle cylinder, are selected by deflecting the bending vibrator 5 according to the programme to one side or the other. In this way, as is likewise known from German Laid-open patent specification No. 1 585 211 (U.S. Pat. No. 3,449,928), the shaded control springs 6, for example, which are directed into the guide track 77, are used for rocking or swinging the associated sliders, whereas the black control springs transferred to the guide track 75 do not effect any rocking of the sliders.

The embodiment according to FIG. 12, in which the deflection of the bending vibrator 5 cannot extend over the range of a relatively broad selection zone, but must be carried out with the needle frequency, has the advantage that in contrast to German Laid-open patent specification No. 1 585 211 (U.S. Pat. No. 3,449,928) no control magnet systems are required, as a result of which the production costs remain low and the disadvantages due to the stray fields of the control magnet systems are eliminated.

The feature common to all the constructional forms which have been described is that for selecting the needles or their control elements such as sliders, sinkers, etc. bendable control springs are associated with them and these control springs bend when an electric or magnetic field is applied and produce a lifting of the needles in their one bending position, whereas in their other position they leave the needles unaffected. According to the invention, in the three embodiments first described (FIGS. 1 to 10), there is associated with each needle at least one control spring in the form of a bending vibrator 5, which is bent without any output, i.e. without performing mechanical work. The forces required for rocking the needles or their control elements or for lifting the needles are applied by supplementary auxiliary means, there being understood by "auxiliary means", for example according to FIGS. 1 to 8, the pressure springs 19, according to FIG. 9 the weight of the sliders and according to FIG. 10 the incline 89 of the cam 83. It is true that in the embodiment last described (FIG. 11) there are associated with the needles only as many routing elements in the form of bending vibrators 5 as there are feeds. In this constructional form also, however, the selection or non-selection of a needle depends on a certain bending position of the bending vibrators, the particular bending position being reached without any output or work being done, so that further auxiliary means, for example the guide tracks 75 and 77, are needed for the selection operation proper.

According to a further development of the invention, in order to protect the bending vibrators from wear, these being frequently sensitive to mechanical abrasion, they may be articulated or rigidly coupled to the control springs known heretofore or may also be covered by a cap 98 (FIG. 2) consisting of a wear-resistant material. For the purpose of increasing the bending amplitude, it is moreover advantageous not simply to turn on or cut off the fields applied to the bending vibrators, but to carry out a polarity reversal, since by polarity reversal more than twice the deflection that is obtained with comparable turning on and off is achieved. Finally, it is advisable to provide the bending vibrators with a return cam by which their normal position required for the selection operation is re-established, since many bending vibrators have a relatively large time constant by which the working rate could be affected.

A particular advantage of many bending vibrators, in particular bending vibrators produced from piezoceramic materials, consists in that their properties can be compared with those of capacitors of high quality. By reason of this characteristic, it is also possible to trigger the bending vibrators with brief pulses. Even if the optimum deflection has not yet been reached at the selected voltage at the end of the pulse, the charge impressed by the pulse also produces a further deflection after the end of the pulse. In the case, for example, of piezoceramic bending vibrators, it is therefore sufficient to trigger the bending vibrator with a pulse having a duration of about one millisecond and then allow it to cease vibrating freely.

So as to avoid those bending vibrators which, in fact, have already been brought into their selection position, but the position of which has not yet resulted in the selection of the associated needle, swinging back freely when the knitting machine is switched off or there is a power failure, second contact tracks 95 (FIGS. 2 to 5) are preferably provided against which the bending vibrators are applied in the two end positions. When the machine is switched off or the main battery fails, holding voltages are automatically applied to these contact tracks 95 by means of suitable auxiliary batteries, these holding voltages maintaining the information stored in the bending vibrators until the machine or the main battery is switched on again.

The invention is not limited to the embodiments which have been described, but can be modified in many respects. In particular, it is not necessary to use only one bending vibrator for each feed or each knitting needle, since, for example, a bending vibrator may be provided in each case for reaching the intercepting or knitting position. Furthermore, the invention can be applied to all knitting machines with individually selectable needles, irrespective of whether these are selected directly or by means of sliders, sinkers or other control elements. Finally, the invention is also suitable for electronically controlled pattern wheels, as known, for example, from German patent specification No. 1 141 046.

In the embodiments in which a longer selection zone is provided for producing the desired bending stte of the bending vibrators, the particular advantage obtains that no high demands are made on the supply of the control pulses in exact time, so that costly synchronization measures can be dispensed with. Moreover, in order to avoid costly commutators as in direct-current machines, there is preferably associated with each bending vibrator a thyristor switch which revolves with the needle cylinder and is turned off by a central timing pulse generator. The triggering of the individual bending vibrators may be effected by way of shift registers with a timing frequency which is obtained from the knitting rate and the number of knitting feeds. In the event of a selection zone being provided, the supply of information to the individual bending vibrators may also be effected with the aid of contact paths fixed to the cambox and which are sensed by the bending vibrators by means of brushes or the like. According to FIG. 14, for example, eight bending vibrators 5 each with a brush 97 are combined to form a group, each brush sensing a different first contact track 99. All eight contact paths 99 are interrupted at the same point and are of equal length, their length corresponding to the length of the selection zone. During the rotation of the needle cylinder in the direction of the arrow P, the individual bending vibrators are connected in succession to a certain voltage corresponding to the contact paths, which is then maintained over the entire length of the contact paths. In the event of magnetostrictive bending vibrators being employed, the voltages picked up from the contact paths 99 are supplied correspondingly to the coils 33 (FIG. 12). The programmed application of the desired voltages to the contact paths 99 may be effected in known manner by reading suitable programme supports.

The embodiment according to FIG. 1 may be modified so that the needles are not fully driven out by the sliders, but are only lifted on to a needle lifting cam by which the needles are then brought into their high position. It is thereby possible to carry the sliders back into their starting position and select them afresh already before the end of the needle lifting cam and keep the frequencies of the bending vibrators small or their deflection large.

Finally, by reason of the good storage properties of piezoelectric bending vibrators, their deflection can be initiated by means of brief control pulses, so that long contact paths (FIG. 14) are not necessary.

I claim:

1. A knitting machine comprising at least one carrier carrying a plurality of knitting needles that may be first electrically selected and then brought from a non-knitting position into a knitting position and carrying at least one jack associated with each knitting needle, each jack being pivotally mounted between an inoperative position and an operative position; means associated with each jack for pivoting the jacks into one of said positions; actuating means for bringing into the knitting position those knitting needles which are associated with a jack in said operative position and leaving in the non-knitting position those needles which are associated with a jack in said inoperative position, at least one unilaterally fastened control spring associated with each jack for selecting the associated knitting needle, said control spring consisting of a material that may be bent or deflected between a first state and a second state by impressing an electric or magnetic field on said control springs, said control springs comprising a multilayer bimetallic element when said field is a magnetic field, each control spring being mounted such that it will only allow those jacks to be pivoted by said pivoting means into said one position when it is in said second state, means for impressing said electric or magnetic field on said control springs in accordance with a pattern to obtain the first or second states; and means for pivoting back the jacks from said one position to said other position.

2. A knitting machine according to claim 1 wherein said control springs consist of piezo-electric elements when said field is an electric field.

3. A knitting machine according to claim 1 wherein said control springs consist of piezo-ceramic elements made by an extrusion process when said field is an electric field.

4. A knitting machine according to claim 1, wherein said carrier is a needle cylinder surrounded by a cam box ring having a recess therein and wherein said control springs are mounted in a respective portion of said needle cylinder.

5. A knitting machine according to claim 1, wherein each jack is associated with a pivotable auxiliary element mounted between said jack and the associated control spring such that it rests against the control spring in the first state to retain the jack in the operative position and that it may be pivoted together with said jack by said spring means when the control spring is in said second state.

6. A knitting machine according to claim 1, wherein said first state is the non-bent or non-deflected state and wherein the second state is the bent or deflected state.

7. A knitting machine according to claim 1, wherein said control springs have electrodes for impressing an electric field by applying an electrical potential to the electrodes.

8. A knitting machine according to claim 7, further comprising first contact-tracks applying the potential to the electrodes of the control springs, and means for connecting said first contact tracks with said electrodes.

9. A knitting machine according to claim 1, further comprising second contact tracks which touch the free ends of the control springs in the second states, a battery connected to said second contact tracks and applying holding voltage to said control springs which prevents pivoting back of said control springs from the one state to the other state when the knitting machine is shut off or when there is power failure.

10. A knitting machine according to claim 1, wherein said control springs have wear-resistant caps.

11. A knitting machine comprising at least one carrier carrying a plurality of knitting needles that may be first electrically selected and then be brought from a non-knitting position into a knitting position independently of one another and carrying at least one jack associated with each knitting needle, each jack being movable by a first means between an inoperative position and an operative position, actuating means for bringing into the knitting position only those knitting needles which are associated with a jack in said operative position, at least one unilaterally fastened control spring associated with each jack, each control spring consisting of a piezo-ceramic material that may be freely bent or deflected between two states by impressing an electric field thereon, and being mounted such that it will allow only those jacks to be moved by said first means into one of said positions when the associated control spring is in one of said two states, means associated with each jack to hold said jack in one of said positions, means for impressing an electric field on each control spring in accordance with a pattern to obtain one of said two states when said jack is in said one position, and means for moving back the jacks from said other position into said one position.

12. A knitting machine in accordance with claim 11, wherein said control springs have electrodes for impressing an elastic field by applying an electrical potential to the electrodes and further comprising first contact tracks applying the potential to the electrodes and means for connecting said first contact tracks with said electrodes.

13. A knitting machine according to claim 11 wherein said control springs have free ends and further comprising second contact tracks which touch the free ends of the control springs in said one state, a battery connected to said second contact tracks and applying holding voltage to said control springs which prevents said control springs from assuming the other of said two states when the knitting machine is shut off or when there is a power failure.

14. A knitting machine according to claim 11, wherein said control springs have wear-resistant caps.

* * * * *